US005881963A

United States Patent [19]

Hinkle

[11] Patent Number: 5,881,963

[45] Date of Patent: Mar. 16, 1999

[54] STRAP RETRACTOR

[76] Inventor: David W. Hinkle, 8213 Pine Bluff Ct., Darien, Ill. 60561

[21] Appl. No.: 44,326

[22] Filed: Mar. 19, 1998

[51] Int. Cl.[6] ..... B65H 75/48

[52] U.S. Cl. ..... 242/378.3; 243/385.4

[58] Field of Search ..... 242/378.1, 378.2, 242/378.3, 375.1, 385.4, 384.7, 388.1, 388.5; 190/115; 150/108

[56] References Cited

U.S. PATENT DOCUMENTS

| | | | |
|---|---|---|---|
| 422,591 | 3/1890 | Hayden | 242/378.3 |
| 2,632,609 | 3/1953 | Kirby | 242/375.1 |
| 3,425,646 | 2/1969 | Hollowell | 242/378.3 |
| 4,417,703 | 11/1983 | Weinhold | 242/378.1 |
| 4,646,987 | 3/1987 | Peterson | 242/378.3 |
| 4,901,938 | 2/1990 | Cantley et al. | 242/378.1 |
| 5,114,091 | 5/1992 | Peterson et al. | 242/378.3 |
| 5,797,558 | 8/1998 | Peterson et al. | 242/378.2 |

*Primary Examiner*—John M. Jillions

[57] ABSTRACT

A new strap retractor for securing an extra length of the strap to prevent snagging. The inventive device includes a cylindrical housing having an open upper end, a closed bottom end, and a cylindrical side wall therebetween. The cylindrical side wall has a pair of diametrically opposed vertical slots therethrough in communication with the open upper end. The vertical slots are dimensioned for receiving a strap therethrough. The closed lower end has a centrally disposed aperture therethrough. A cap portion snapidly engages the open upper end of the cylindrical housing. The cap portion has a circular flange disposed centrally on an interior surface thereof in alignment with the aperture in the closed lower end of the cylindrical housing. A shaft is rotatably received within the aperture in the closed lower end of the cylindrical housing. An upper end of the shaft is positioned within the circular flange of the cap portion. The shaft has a vertical slot therethrough in alignment with the vertical slots of the cylindrical housing. The vertical slot is dimensioned for receiving a strap therethrough.

5 Claims, 2 Drawing Sheets

FIG 1
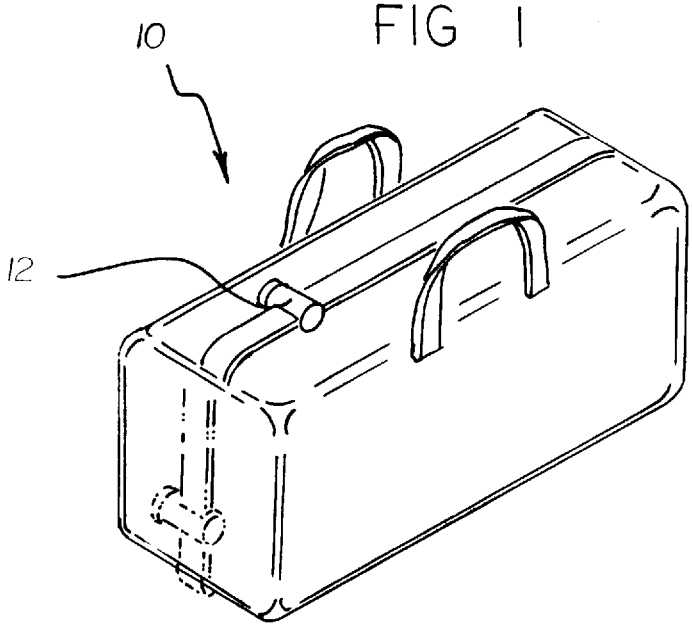
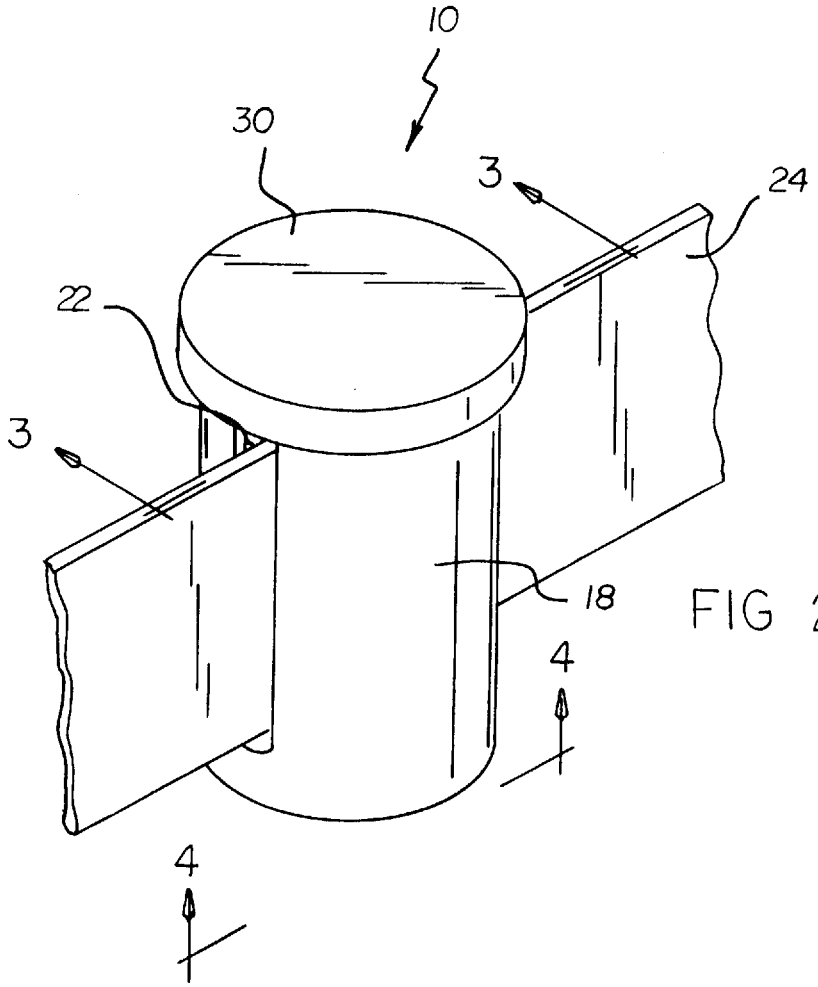
FIG 2

STRAP RETRACTOR

BACKGROUND OF THE INVENTION

1. Field of the Invention

The present invention relates to retractors and more particularly pertains to a new strap retractor for securing an extra length of the strap to prevent snagging.

2. Description of the Prior Art

The use of retractors is known in the prior art. More specifically, retractors heretofore devised and utilized are known to consist basically of familiar, expected and obvious structural configurations, notwithstanding the myriad of designs encompassed by the crowded prior art which have been developed for the fulfillment of countless objectives and requirements.

Known prior art retractors include U. S. Pat. No. 3,941,330 to Ulrich; U.S. Pat. No. 4,964,370 to Peterson; U.S. Pat. No. 4,887,551 to Musetti; U.S. Pat. No. 3,982,613 to Wood; U.S. Pat. No. 4,165,713 to Brawner et al.; and U.S. Pat. No. Des. 298,368 to Musetti.

While these devices fulfill their respective, particular objectives and requirements, the aforementioned patents do not disclose a new strap retractor. The inventive device includes a cylindrical housing having an open upper end, a closed bottom end, and a cylindrical side wall therebetween. The cylindrical side wall has a pair of diametrically opposed vertical slots therethrough in communication with the open upper end. The vertical slots are dimensioned for receiving a strap therethrough. The closed lower end has a centrally disposed aperture therethrough. A cap portion snapidly engages the open upper end of the cylindrical housing. The cap portion has a circular flange disposed centrally on an interior surface thereof in alignment with the aperture in the closed lower end of the cylindrical housing. A shaft is rotatably received within the aperture in the closed lower end of the cylindrical housing. An upper end of the shaft is positioned within the circular flange of the cap portion. The shaft has a vertical slot therethrough in alignment with the vertical slots of the cylindrical housing. The vertical slot is dimensioned for receiving a strap therethrough.

In these respects, the strap retractor according to the present invention substantially departs from the conventional concepts and designs of the prior art, and in so doing provides an apparatus primarily developed for the purpose of securing an extra length of the strap to prevent snagging.

SUMMARY OF THE INVENTION

In view of the foregoing disadvantages inherent in the known types of retractors now present in the prior art, the present invention provides a new strap retractor construction wherein the same can be utilized for securing an extra length of the strap to prevent snagging.

The general purpose of the present invention, which will be described subsequently in greater detail, is to provide a new strap retractor apparatus and method which has many of the advantages of the retractors mentioned heretofore and many novel features that result in a new strap retractor which is not anticipated, rendered obvious, suggested, or even implied by any of the prior art retractors, either alone or in any combination thereof.

To attain this, the present invention generally comprises a cylindrical housing having an open upper end, a closed bottom end, and a cylindrical side wall therebetween. The cylindrical side wall extends downwardly beyond the closed bottom end thereby forming a lower collar. The cylindrical side wall has a pair of diametrically opposed vertical slots therethrough in communication with the open upper end. The vertical slots are dimensioned for receiving a strap therethrough. The closed lower end has a centrally disposed aperture therethrough. The closed lower end has a post extending upwardly therefrom interiorly of the cylindrical housing. The post is tangentially disposed with respect to the aperture. A cap portion snapidly engages the open upper end of the cylindrical housing. The cap portion has a circular flange disposed centrally on an interior surface thereof in alignment with the aperture in the closed lower end of the cylindrical housing. A shaft is rotatably received within the aperture in the closed lower end of the cylindrical housing. An upper end of the shaft is positioned within the circular flange of the cap portion. A lower end of the shaft protrudes outwardly of the aperture in the closed lower end. The shaft has a vertical slot therethrough in alignment with the vertical slots of the cylindrical housing. The vertical slot is dimensioned for receiving a strap therethrough. A spring is rotatably coupled to the shaft upwardly its lower end disposed interiorly of the cylindrical housing. The spring is positioned inwardly of the post of the cylindrical housing. A ratchet is secured to the lower end of the shaft disposed exteriorly of the cylindrical housing. The ratchet includes a locking pawl pivotally secured to an exterior surface of the closed lower end of the cylindrical housing whereby the locking pawl selectively engages the ratchet to preclude rotation of the shaft. A dial is secured to the lower end of the shaft disposed downwardly of the ratchet. The dial includes a knurled peripheral edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new strap retractor apparatus and method which has many of the advantages of the retractors mentioned heretofore and many novel features that result in a new strap retractor which is not anticipated, rendered obvious, suggested, or even implied by any of the prior art retractors, either alone or in any combination thereof.

It is another object of the present invention to provide a new strap retractor which may be easily and efficiently manufactured and marketed.

It is a further object of the present invention to provide a new strap retractor which is of a durable and reliable construction.

An even further object of the present invention is to provide a new strap retractor which is susceptible of a low cost of manufacture with regard to both materials and labor, and which accordingly is then susceptible of low prices of sale to the consuming public, thereby making such strap retractor economically available to the buying public.

Still yet another object of the present invention is to provide a new strap retractor which provides in the apparatuses and methods of the prior art some of the advantages thereof, while simultaneously overcoming some of the disadvantages normally associated therewith, such as high stresses or strains on the retractor.

Still another object of the present invention is to provide a new strap retractor for securing an extra length of the strap to prevent snagging while eliminating stresses or strains on the retractor's elements.

Yet another object of the present invention is to provide a new strap retractor which includes a cylindrical housing having an open upper end, a closed bottom end, and a cylindrical side wall therebetween. The cylindrical side wall has a pair of diametrically opposed vertical slots therethrough in communication with the open upper end. The vertical slots are dimensioned for receiving a strap therethrough. The closed lower end has a centrally disposed aperture therethrough. A cap portion snapidly engages the open upper end of the cylindrical housing. The cap portion has a circular flange disposed centrally on an interior surface thereof in alignment with the aperture in the closed lower end of the cylindrical housing. A shaft is rotatably received within the aperture in the closed lower end of the cylindrical housing. An upper end of the shaft is positioned within the circular flange of the cap portion. The shaft has a vertical slot therethrough in alignment with the vertical slots of the cylindrical housing. The vertical slot is dimensioned for receiving a strap therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new strap retractor according to the present invention illustrated in use.

FIG. 2 is an isolated perspective view of the present invention.

DESCRIPTION OF THE PREFERRED EMBODIMENT

Figure 3:
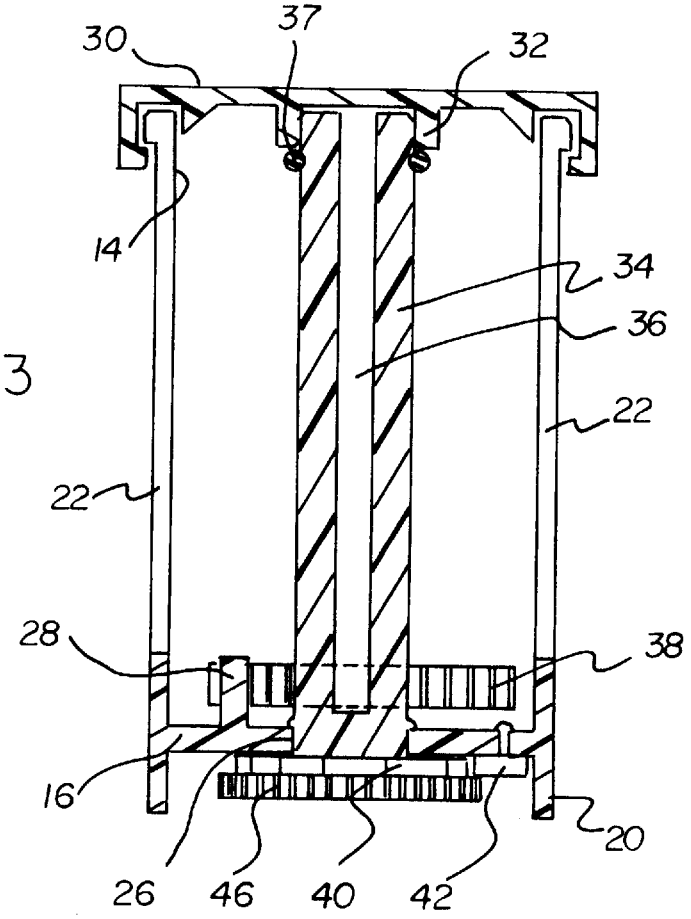
FIG. 3 is a cross-sectional view of the present invention as taken along line 3—3 of FIG. 2.
Figure 4:
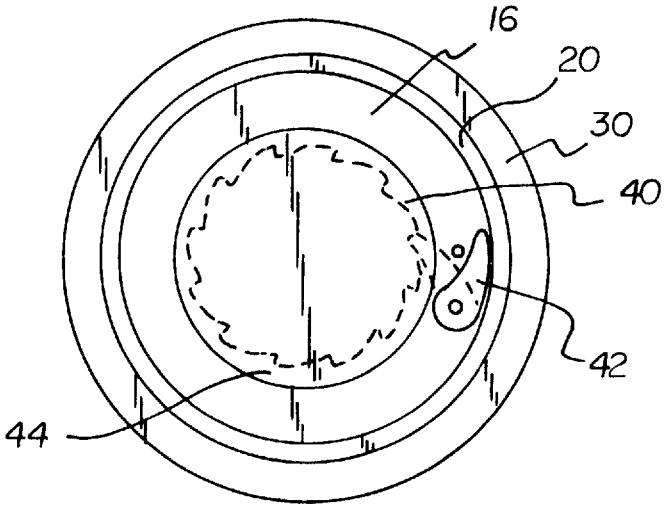
FIG. 4 is a bottom plan view of the present invention as taken along line 4—4 of FIG. 2.

With reference now to the drawings, and in particular to FIGS. 1 through 4 thereof, a new strap retractor embodying the principles and concepts of the present invention and generally designated by the reference numeral 10 will be described.

As best illustrated in FIGS. 1 through 4, the strap retractor 10 comprises a cylindrical housing 12 having an open upper end 14, a closed bottom end 16, and a cylindrical side wall 18 therebetween. The cylindrical side wall 18 extends downwardly beyond the closed bottom end 16 thereby forming a lower collar 20. The cylindrical side wall 18 has a pair of diametrically opposed vertical slots 22 therethrough in communication with the open upper end 14. The vertical slots 22 are dimensioned for receiving a strap 24 therethrough. The closed lower end 16 has a centrally disposed aperture 26 therethrough. The closed lower end 26 has a post 28 extending upwardly therefrom interiorly of the cylindrical housing 12. The post 28 is tangentially disposed with respect to the aperture 26.

A cap portion 30 snapidly engages the open upper end 14 of the cylindrical housing 12. The cap portion 30 has a circular flange 32 disposed centrally on an interior surface thereof in alignment with the aperture 26 in the closed lower end 16 of the cylindrical housing 12.

A shaft 34 is rotatably received within the aperture 26 in the closed lower end 16 of the cylindrical housing 12. An upper end of the shaft is positioned within the circular flange 32 of the cap portion 30. A lower end of the shaft 34 protrudes outwardly of the aperture 26 in the closed lower end 16. The shaft 34 has a vertical slot 36 therethrough in alignment with the vertical slots 22 of the cylindrical housing 12. The vertical slot 36 is dimensioned for receiving a strap 24 therethrough. The vertical slot 36 is knurled or roughened to grip the strap 24. A keeper ring or band 37 secures the strap 24 in position.

A spring 38 is rotatably coupled to the shaft 34 upwardly its lower end disposed interiorly of the cylindrical housing 12. The spring 38 is positioned inwardly of the post 28 of the cylindrical housing 12.

A ratchet 40 is secured to the lower end of the shaft 34 disposed exteriorly of the cylindrical housing 12. The ratchet 40 has a toothed peripheral edge includes a locking pawl 42 pivotally secured to an exterior surface of the closed lower end 16 of the cylindrical housing 12 whereby the locking pawl 42 selectively engages the toothed peripheral edge of ratchet 40 to preclude rotation of the shaft 34.

A dial 44 is secured to the lower end of the shaft 34 disposed downwardly of the ratchet 40. The dial 44 includes a knurled peripheral edge 46.

In use, the cap portion 30 would be removed and a strap 24 would be threaded through the slots 22 of the cylindrical side wall 18 and the slot 36 in the shaft 34 and held in place through the post 28. The cap portion 30 would then be replaced and the ratchet 40 released. The device 10 would automatically draw the loose strap 24 into a shorter length. To lengthen the strap 24, the individual would simply pull lightly upon it. When the cap portion 30 is in place, the shaft 34 would be closed slightly and secured by ring/band 37 to ensure the device 10 remained in place. To reposition the device 10 along the strap 24, the individual would extend the strap 24 to its maximum length. Next, the ratchet 40 would be engaged by the locking pawl 42, and the cap portion 30 and ring/band 37 would be removed. The device 10 would be slid along the strap 24 to the desired position. Finally, the ring/band 35 and the cap portion 30 would be replaced. In order to take up the slack in the strap 24, the locking pawl 42 would be removed from the ratchet 40. The length of the strap 24 which would be retracted would depend upon the amount of tension in the spring 38 and the thickness of the strap 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A strap retractor for securing an extra length of the strap to prevent snagging comprising, in combination:

a cylindrical housing having an open upper end, a closed bottom end, and a cylindrical side wall therebetween, the cylindrical side wall extending downwardly beyond the closed bottom end thereby forming a lower collar, the cylindrical side wall having a pair of diametrically opposed vertical slots therethrough in communication with the open upper end, the vertical slots dimensioned for receiving a strap therethrough, the closed lower end having a centrally disposed aperture therethrough, the closed lower end having a post extending upwardly therefrom interiorly of the cylindrical housing, the post being tangentially disposed with respect to the aperture;

a cap portion snapidly engaging the open upper end of the cylindrical housing, the cap portion having a circular flange disposed centrally on an interior surface thereof in alignment with the aperture in the closed lower end of the cylindrical housing;

a shaft rotatably received within the aperture in the closed lower end of the cylindrical housing, an upper end of the shaft positioned within the circular flange of the cap portion, a lower end of the shaft protrudes outwardly of the aperture in the closed lower end, the shaft having a vertical slot therethrough in alignment with the vertical slots of the cylindrical housing, the vertical slot dimensioned for receiving a strap therethrough;

a spring rotatably coupled to the shaft upwardly its lower end disposed interiorly of the cylindrical housing, the spring being positioned inwardly of the post of the cylindrical housing;

a ratchet secured to the lower end of the shaft disposed exteriorly of the cylindrical housing, the ratchet including a locking pawl pivotally secured to an exterior surface of the closed lower end of the cylindrical housing whereby the locking pawl selectively engaging the ratchet to preclude rotation of the shaft; and a dial secured to the lower end of the shaft disposed downwardly of the ratchet, the dial including a knurled peripheral edge.

2. A strap retractor for securing an extra length of the strap to prevent snagging comprising, in combination:

a cylindrical housing having an open upper end, a closed bottom end, and a cylindrical side wall therebetween, the cylindrical side wall having a pair of diametrically opposed vertical slots therethrough in communication with the open upper end, the vertical slots dimensioned for receiving a strap therethrough, the closed lower end having a centrally disposed aperture therethrough, the closed lower end having a post extending upwardly therefrom interiorly of the cylindrical housing;

a cap portion snapidly engaging the open upper end of the cylindrical housing, the cap portion having a circular flange disposed centrally on an interior surface thereof in alignment with the aperture in the closed lower end of the cylindrical housing;

a shaft rotatably received within the aperture in the closed lower end of the cylindrical housing, an upper end of the shaft positioned within the circular flange of the cap portion, the shaft having a vertical slot therethrough in alignment with the vertical slots of the cylindrical housing, the vertical slot dimensioned for receiving a strap therethrough; and a ratchet secured to a lower end of the shaft disposed exteriorly of the cylindrical housing,the ratchet including a locking pawl pivotally secured to an exterior surface of the closed lower end of the cylindrical housing whereby the locking pawl selectively engages the ratchet to preclude rotation of the shaft.

3. The strap retractor as set forth in claim 2 and further including a spring rotatably coupled to the shaft upwardly a lower end thereof disposed interiorly of the cylindrical housing, the spring being positioned inwardly of the post of the cylindrical housing.

4. A strap retractor for securing an extra length of the strap to prevent snagging comprising, in combination:

a cylindrical housing having an open upper end, a closed bottom end, and a cylindrical side wall therebetween, the cylindrical side wall having a pair of diametrically opposed vertical slots therethrough in communication with the open upper end, the vertical slots dimensioned for receiving a strap therethrough, the closed lower end having a centrally disposed aperture therethrough, the closed lower end having a post extending upwardly therefrom interiorly of the cylindrical housing;

a cap portion snapidly engaging the open upper end of the cylindrical housing, the cap portion having a circular flange disposed centrally on an interior surface thereof in alignment with the aperture in the closed lower end of the cylindrical housing;

a shaft rotatably received within the aperture in the closed lower end of the cylindrical housing, an upper end of the shaft positioned within the circular flange of the cap portion, the shaft having a vertical slot therethrough in alignment with the vertical slots of the cylindrical housing, the vertical slot dimensioned for receiving a strap therethrough;

a spring rotatably coupled to the shaft upwardly a lower end thereof disposed interiorly of the cylindrical housing, the spring being positioned inwardly of the post of the cylindrical housing; and a ratchet secured to the lower end of the shaft disposed exteriorly of the cylindrical housing, the ratchet including a locking pawl pivotally secured to an exterior surface of the closed lower end of the cylindrical housing whereby the locking pawl selectively engaging the ratchet to preclude rotation of the shaft.

5. The strap retractor as set forth in claim 4 and further including a dial secured to the lower end of the shaft disposed downwardly of the ratchet, the dial including a knurled peripheral edge.

* * * * *